United States Patent [19]

Schippers et al.

[11] 4,340,187

[45] Jul. 20, 1982

[54] BOBBIN CHANGING APPARATUS

[75] Inventors: Heinz Schippers, Remscheid; Norbert Hufer, Radevormwald; Gerd Münnekehoff, Remscheid; Udo Teich, Sprockhövel, all of Fed. Rep. of Germany

[73] Assignee: Barmag Barmer Maschinenfabrik, Remscheid, Fed. Rep. of Germany

[21] Appl. No.: 191,350

[22] Filed: Sep. 26, 1980

[30] Foreign Application Priority Data

Sep. 29, 1979 [DE] Fed. Rep. of Germany ..... 2939675

[51] Int. Cl.[3] ..... B65H 54/26; B65H 67/04

[52] U.S. Cl. ..... 242/35.5 A; 57/269; 57/270; 242/36

[58] Field of Search ..... 242/35.5 A, 35.5 R, 242/35.6 R, 18 R, 18 A, 36, 18 DD, 18 PW, 41; 57/268, 269, 270, 271

[56] References Cited

U.S. PATENT DOCUMENTS

| | | | |
|---|---|---|---|
| 3,791,126 | 2/1974 | Kose et al. | 242/35.5 A X |
| 3,820,730 | 6/1974 | Endo et al. | 242/35.5 A X |
| 3,895,725 | 7/1975 | Mayer | 214/41 |
| 3,915,398 | 10/1975 | Corl | 242/35.5 A |
| 3,987,974 | 10/1976 | Mayer | 242/35.5 A |
| 4,007,882 | 2/1977 | Isoard | 242/35.5 A X |
| 4,023,743 | 5/1977 | Schippers | 242/35.5 A |
| 4,041,686 | 8/1977 | Inaba et al. | 242/35.5 A X |
| 4,052,017 | 10/1977 | Schar | 242/35.5 A |
| 4,069,983 | 1/1978 | Muramatsu et al. | 242/35.5 A X |
| 4,079,898 | 3/1978 | Murakami et al. | 242/35.5 A |
| 4,116,395 | 9/1978 | Courvoisier | 242/35.5 A |
| 4,138,072 | 2/1979 | Aoyama et al. | 242/35.5 A |
| 4,153,211 | 5/1979 | Lenk et al. | 242/35.5 A |
| 4,226,567 | 10/1980 | Van Orsdale, Jr. | 242/35.5 A X |

FOREIGN PATENT DOCUMENTS

| | | |
|---|---|---|
| 2937620 | 9/1979 | Fed. Rep. of Germany . |
| 1399891 | 6/1972 | United Kingdom . |

*Primary Examiner*—Stanley N. Gilreath

*Attorney, Agent, or Firm*—Bell, Seltzer, Park & Gibson

[57] ABSTRACT

A bobbin changing apparatus is provided which is adapted for use in association with a textile yarn processing machine having a plurality of winding stations, and wherein the apparatus comprises a thread operating carriage and a separate doffing carriage, which are mounted for independent movement on a common trackway. The thread operating carriage acts to sever and withdraw the advancing yarn during the bobbin changing operation, and upon an empty bobbin being mounted at the winding station, to then deliver the yarn to the automatic thread-up mechanism on the winding head of the machine. The doffing carriage includes a mandrel for receiving the full bobbins, and since the doffing carriage is independent of the thread operating carriage, the doffing carriage is free to immediately move from the winding station to deliver the full bobbin to a separate creel, or to perform a quality control analysis of the full bobbin. The thread operating carriage preferably carries a supply of empty bobbins, and includes a mechanism for donning the empty bobbins after the doffing operations have been completed by the doffing carriage.

18 Claims, 14 Drawing Figures

BOBBIN CHANGING APPARATUS

The present invention relates to a bobbin changing apparatus for use with a textile yarn processing machine having a plurality of yarn winding stations aligned along one or both sides thereof.

A bobbin transport apparatus is disclosed in German Auslegeschrift No. 2,123,689, and U.S. Pat. No. 3,895,725, which comprises a carriage which is movable along the front of a textile processing machine, and which includes means for doffing the full bobbins and delivering such bobbins to a creel.

The present trend in the textile industry toward ever increasing bobbin weights, increased yarn velocities and shorter bobbin wind cycles has led to the obsolenscence of the above bobbin transport device because with the increased bobbin weight, the carriage for doffing the full bobbins must also be increased in size, which in turn has led to a reduction in its mobility.

It is an object of the present invention to avoid the above limitations of the prior bobbin transport device. Specifically, and in accordance with the present invention, there is provided a bobbin changing apparatus which is divided into two components, and consists of a thread operating carriage, and a separate doffing carriage, with both carriages being movable along the front of the textile machine separately from each other. The development of microprocessors has allowed both carriages to be connected operatively together, and with the individual winding stations.

The division according to this invention of the bobbin changing apparatus into a thread operating carriage and a doffing carriage provides the advantage that the thread operating function which is to be performed during the bobbin change is independent of the doffing function. The thread operating function particularly involves removing the yarn from its yarn path maintained during the bobbin wind cycle, severing the continuous yarn and removing the continuous yarn by suction during the bobbin change to a waste container, and also re-inserting the continuous yarn onto the empty bobbin tube after it is mounted at the winding station.

The doffing function particularly involves doffing the full bobbins and transferring these bobbins from the winding station onto a bobbin transport device. This bobbin transport device may particularly be a bobbin creel, as shown for example in the above referenced German and U.S. patents. Deviating from the embodiment according to these prior patents however, the creel of the present invention does not have to stand directly adjacent the doffing carriage. Since the thread operating function as performed by the thread operating carriage is independent of the doffing function and the doffing carriage, the doffing carriage may undertake independent operations, such as transporting the doffed full bobbins to a bobbin transport device or creel, which may be positioned at the head end of the textile machine, and during performance of the yarn handling operations by the thread operating carriage.

In this allocation of the functions to be performed during the bobbin change to two separately operating functional units, it is preferable to also allocate to the thread operating carriage the functions of storing the empty bobbin tubes and donning the empty tubes onto the mounting spindle of the winding station. For this object, the thread operating carriage comprises a storage compartment for the empty bobbin tubes, and donning means for transferring empty tubes from the storage compartment to the respective mounting spindles of the winding station. The storage compartment has, in the preferred embodiment, a lateral outlet for sequentially delivering one or more empty tubes which are axially aligned. The donning means of the thread operating carriage comprises a pivoting arm which carries a clamping device for the aligned empty tubes at its free end and which may be pivoted with the clamping device between the outlet of the storage compartment and the axis of the mounting spindle of each winding station. Furthermore, the thread operating carriage preferably includes means by which the tubes clamped in the clamping device may be moved in an axial direction onto the mounting spindle. For this purpose, the empty tubes may be moved axially through the clamping device, but it is also possible to impart a corresponding movement to the clamping device itself.

In order to ensure the mobility of the two individual carriages of the bobbin changing apparatus, it is advantageous to associate a stationary microprocessor which controls the functional sequence of the bobbin change with the textile machine. The microprocessor is operatively interconnected to the individual carriages of the bobbin changing apparatus by flexible tow lines or cables, and the microprocessor is also operatively connected with each of the winding stations of the textile machine.

As indicated above, the bobbin transport device or creel whose function it is to transport full bobbins produced on the textile machine away from this machine (e.g. for quality control, further processing, packing etc.) may be moved with the doffing carriage, but this does not have to be the case. Preferably, the bobbin transport device, which necessarily is of an extremely stable construction for receiving the very heavy bobbins, is stationed at one end of the textile machine until it has been loaded. It is possible to program the operations of the doffing carriage such that this carriage transfers the bobbins onto the transport device or creel in a predetermined arrangement corresponding to the winding stations of the textile machine, in the manner suggested in the above referenced German and U.S. patents, to permit the allocation of the full bobbins to their respective winding stations, and thereby facilitate quality control.

In the preferred embodiment of the present invention, the doffing carriage comprises a freely projecting horizontal mandrel, assuming the winding stations of the associated textile machine also have winding spindles projecting outwardly from the front of the machine in a corresponding horizontal direction. This mandrel is vertically movable on an upstanding center support, and is pivotable about a pivoting axis parallel to the center support. Further, the mandrel may be moved horizontally in each of the two directions. By this arrangement, it is ensured that the doffing mandrel may be aligned with respective mounting spindles of the winding stations, and with the respective receiving pins of the bobbin transport device.

It has proved to be a disadvantage in the automatic handling of full bobbins that yarn ends unavoidably hang down. In accordance with one embodiment of the present invention, this disadvantage is overcome in that the mandrel of the bobbin doffing carriage is surrounded concentrically by a cylindrical heating wire. By this arrangement, the yarn ends are melted and severed by the heating wire such that they can no longer be a hindrance. The heating wire is advantageously positioned on the inner circumference of a cylindrical jacket which is sized to concentrically surround the mandrel and the full bobbin.

The bobbins are transferred or ejected from the winding spindles by a push-out device associated with each winding station, which push-out device preferably catches behind the bobbin tubes. A push-out device of this type is shown, for example, in German Pat. No. 2,438,363 and U.S. Pat. No. 3,974,973. A winding spindle in the form of a clamping chuck of a type which may be used with the present invention is shown in German Pat. No. 2,106,493 and U.S. Pat. No. 3,185,836. However, it is also possible to use different types of clamping chucks, thus for example, according to German Offenlegungsschrift Nos. 2,719,853 and 2,854,715, the clamping chucks may be opened pneumatically. In order to doff the full bobbins where these clamping chucks are employed, push-out devices suffice which perform exclusively one axial movement, note for example British Pat. No. 870 402.

The full bobbins are doffed from the receiving mandrel of the bobbin doffing carriage by an axially movable push-out device which is associated with the bobbin doffing carriage.

In the winding of freshly spun and/or drawn synthetic fibers, it is often provided that two or more empty tubes be clamped onto the winding spindles so that two or more bobbins are concurrently produced. For this purpose, the receiving mandrel of the bobbin doffing carriage has an axial length equal to that of several bobbins. However, the operation of the bobbin doffing carriage may be controlled such that only one bobbin is transferred from the receiving mandrel of the bobbin doffing carriage to each depositing point (e.g. pin) of the bobbin transport device or creel. This is particularly advantageous when the bobbins are to be directly further processed and the bobbin transport device is simultaneously used as a feeding creel for the further yarn processing.

Dividing the thread operating functions and the bobbin doffing functions in accordance with the present invention further enables the bobbin doffing carriage to be provided with a weighing device for the full bobbins. For this purpose, the bobbin doffing carriage preferably has two pairs of fork-like cradles which are horizontally aligned and are positioned such that by lowering the receiving mandrel of the bobbin doffing carriage, the ends of the tube of each bobbin may be lowered onto a pair of the cradles. The weighing device may be connected to the microprocessor and a printing device to print out the weight.

As stated above, the first step of the thread operating function is to remove the yarn from its yarn path maintained during the bobbin wind cycle, sever the yarn, and then remove the continuous yarn by suction during the bobbin change. In order to implement these functions, the thread operating carriage comprises spaced apart yarn guides which may be moved substantially horizontally and parallel to the plane of the traversing triangle of the yarn to be removed, and also yarn deflection members which may be moved out parallel thereto and past the end of the movement path of the thread guides, whereby a yarn loop may be produced by moving the yarn guides substantially into the yarn path and then moving the deflection members across the yarn path and subsequently retracting the deflection members. The thread operating carriage includes a thread cutter and a thread suction device in the region of the yarn loop, and preferably in the region of the apex of the yarn loop, and is further provided with a waste container for the yarn waste. The yarn drawn into the yarn loop, may thereby be severed and then continuously removed by suction. At this stage, the bobbin change may be effected in that the full bobbin or bobbins are transferred from the bobbin mounting spindle of the winding station onto the mandrel of the bobbin doffing carriage. The bobbin doffing carriage may then transfer the full bobbins onto a bobbin transport device which, as described above, is standing ready at a selected place.

In the meantime, the function of the empty bobbin tube transfer or donning is effected by the thread operating carriage. The mechanical structure of the thread operating carriage which is required for this purpose has already been mentioned.

It has been found that considerable yarn tensions may occur during the thread operating functions as described above, which may lead to a yarn break and thereby to an interruption in the automatic bobbin changing procedure. According to the present invention, this potential problem is alleviated in that the thread guides and/or deflection members are designed as rollers which are driven at a peripheral speed which substantially corresponds to the thread velocity. Air turbines are preferably issued to drive the rollers. In order to provide for the mobility of the rollers, they are mounted respectively on support arms which are designed as tubes and are charged with compressed air. By this arrangement, tube connections in the region of the yarn path are avoided which could disturb the yarn from its path. A suitable thread overrun roller of this type is disclosed for example in U.S. Pat. No. 3,746,233.

For the formation of the yarn loop, it is preferably provided that for each yarn path, two thread overrun guides are positioned substantially vertically below each other, and that also for each yarn path, two deflection members are positioned substantially vertically below each other, whereby the deflection members may be moved between the two thread overrun guides. The support arm mounting the thread overrun guides also mounts a thread cutter and a thread suction device, the latter two devices being located in a region which is traversed by the deflection members in their drawn-in position, facing away from the machine. Thus, the yarn segment extending between the deflection members is brought into contact with the thread cutter and the cut end is removed by suction, see for example, German Auslegeschrift No. 1,952,231.

Some of the objects having been stated, other objects will appear as the description proceeds, when taken in connection with the accompanying drawings in which—

FIG. 1 is a perspective view of a thread operating carriage in accordance with the present invention;

FIGS. 2*a* through 2*d* are perspective views of a doffing carriage in accordance with the present invention and in several phases of its operation;

FIGS. 3*a* through 3*e* are perspective views of a winding head for winding synthetic fibers and illustrating parts of the thread operating carriage and the doffing carriage of the present invention, and further illustrating the different phases of the bobbin change procedure;

Figure 1:
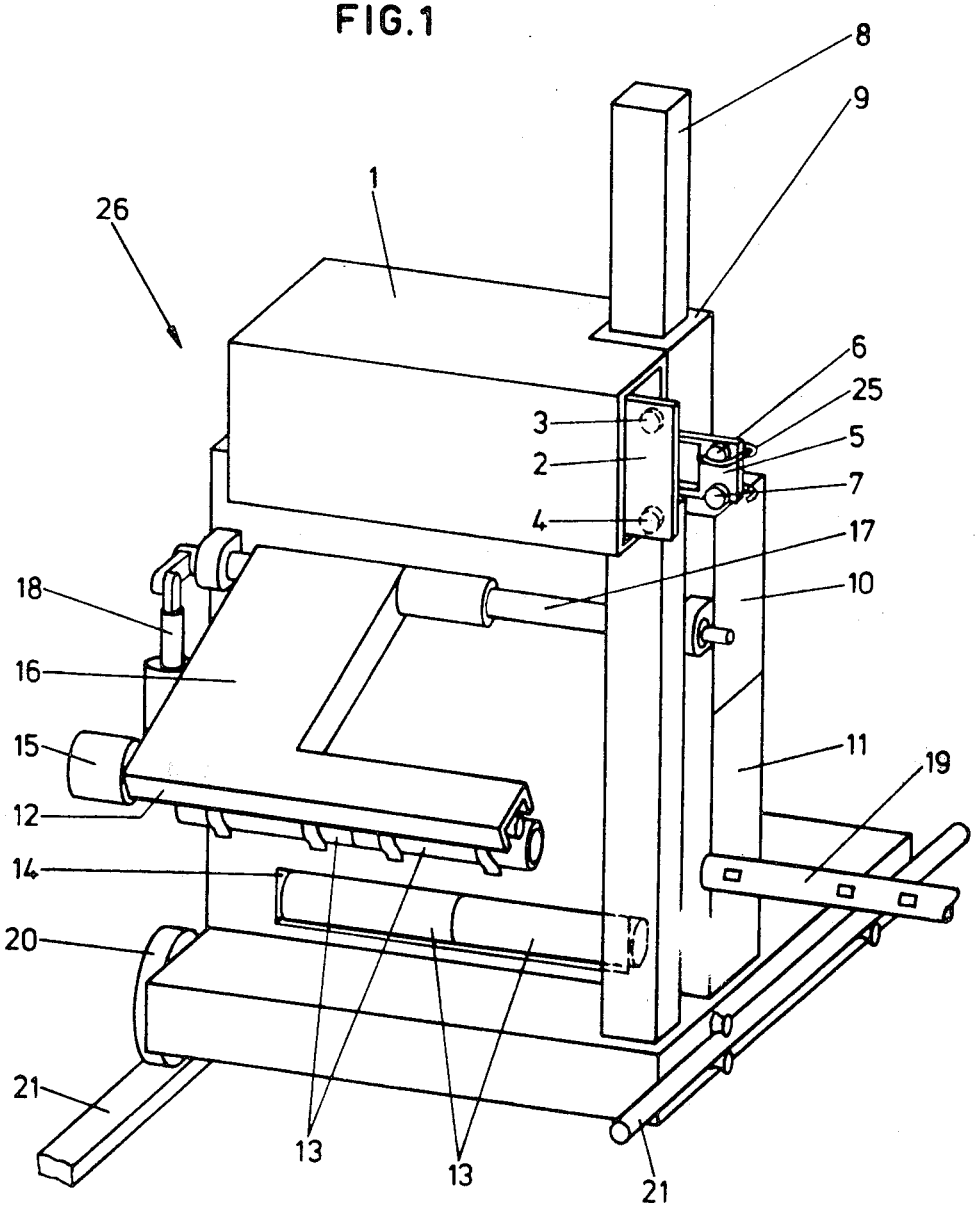

Referring more specifically to the drawings, a thread operating carriage in accordance with the present invention is illustrated generally at 26 in FIG. 1. The carriage 26 may be moved along the front of the textile machine on rails 21 by a self-contained drive unit or the like (not shown), and comprises a housing 1, a wheel 20 operatively associated with one of the rails 21, and a vertical support column 8 upon which the housing may be moved in a vertical direction by a suitable drive means (not shown), such as a cylinder-piston unit, a chain or cable pull, or the like.

The housing 1 supports the mechanisms for producing a yarn loop from the advancing yarn and also for severing and removing by suction the advancing yarn. In the illustrated embodiment, these mechanisms include a first support arm 2 mounting two pairs of vertically spaced apart thread overrun guides 3, 4, and a second support arm 5 mounting one pair of vertically spaced apart thread deflection members 6, 7 at the free end thereof. The support arm 2 and support arm 5 may be moved out horizontally and substantially perpendicular to the direction of movement of the thread operating carriage. It should be noted here that the reach of support arm 5 is greater than that of support arm 2. It is advantageous to design the thread overrun guides 3, 4 and thread deflection members 6, 7 as driven rollers which rotate at a speed approximating the yarn velocity to alleviate the problem of yarn breakage. The rollers are preferably driven by a pneumatic turbine. For this purpose, the support arms 2 and 5 are hollow and are connected to a supply of compressed air via the two line 28 (FIG. 4), which includes a flexible pipe, for the thread operating carriage. The turbine is positioned on the same axis as the rollers.

Figures 3A, 3B, 3C, 3D, 3E:
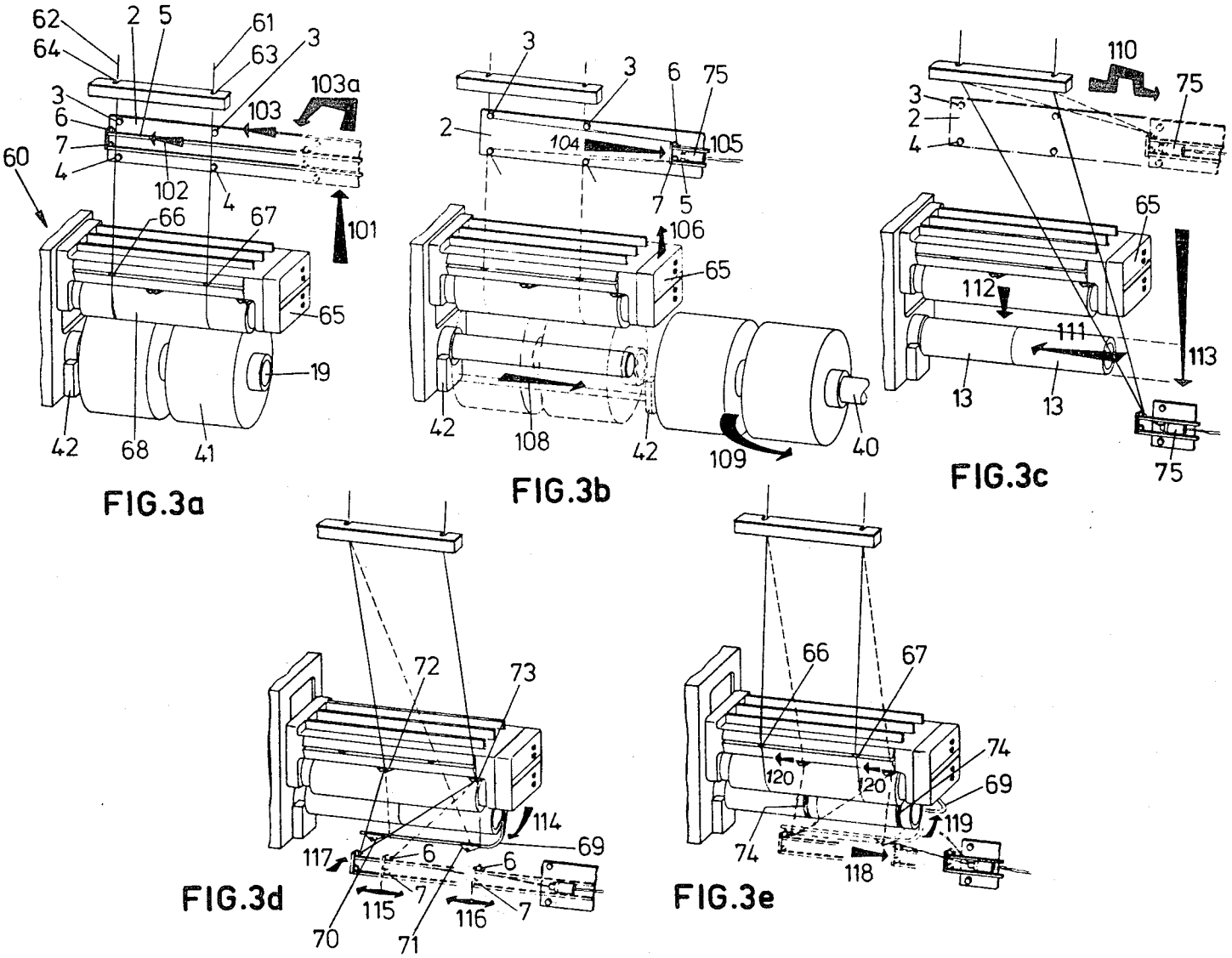

As may be seen from FIG. 3*b*, a thread cutting and suction device 75 is located on the support arm 5 at an elevation between the thread deflection members 6 and 7. The device 75 contains on one side a suction opening which is slit along the yarn run extending between the deflection members 6 and 7, and further includes a cutting device for the yarn at the yarn outlet side of the slit. The thread operating carriage also contains a storage compartment 10 for the yarn waste, which is removed by the suction device 75. Also, the thread operating carriage includes a motordriven fan (not shown) to produce the necessary low pressure for the suction device 75.

The thread operating carriage 26 also comprises a storage compartment 11 for supporting a plurality of empty bobbin tubes 13 in an orderly arrangement. The storage compartment has an opening 14 in which two aligned empty tubes 13 are revealed. A clamping device 12 is provided which is designed to move into the opening 14 and to engage one or more axially aligned tubes between two clamping jaws. For this purpose, an arm 16, which may be pivoted about the pivoting axis 17, is provided which is designed such that it is disposed behind the column 8 when it is pivoted downwardly so as not to obstruct the up and down movement of the housing 1. The pivoting movement is effected by a cylinder-piston unit 18. Reference numeral 19 indicates a mounting spindle which is part of a winding head located on the adjacent textile machine. A winding head of this type is shown in more detail in FIGS. 3*a* through 3*e*.

The arm 16 may be pivoted and positioned such that the empty tubes 13, which are clamped into the clamping device 12 are aligned with the mounting spindle 19. The arm 16 may also be moved along the axis 17 by a suitable driving device (not shown), until the clamped tubes 13 and the spindle 19 are aligned a short distance apart. By means of a driving motor 15 and a suitable push-out device (e.g. a revolving chain), the tubes 13 may now be pushed out axially from the clamping device 12 and pushed out into the spindle 19. Drive elements which are suitable for this purpose are illustrated, for example, in German Offenlegungsschrift Nos. 2,123,689, and 2,128,974.

Figure 2A:
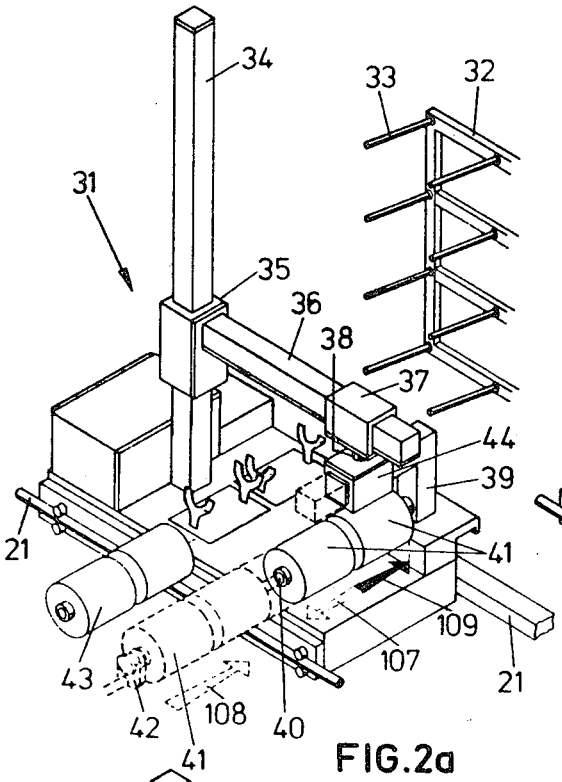

FIGS. 2*a* through 2*d* show a doffing carriage 31 in accordance with the present invention in several phases of its operation. The doffing carriage 31 may also be moved on the rails 21 by a suitable drive unit (not shown), and comprises a base plate upon which there is mounted a vertical column 34. A slide 35 is slidably supported on the column 34, and an extension arm 36 is fixed on the slide 35. A trolley 37 includes a pivoting axle 38, which is parallel to the column 34, on which is mounted a sliding block 44. A U-shaped supporting bracket 39 may be moved with the receiving mandrel 40 in the plane of the U in the sliding block 44. The associated drive devices are not shown here in detail, however, it may be seen from the drawing that the mandrel 40 is vertically movable, may be moved horizontally in both the direction of the extension arm 36 and the direction of the axis of the mandrel 40, and may also perform a pivoting movement about the axle 38. A creel 32 is also illustrated which comprises several creeling pins 33. Furthermore, FIG. 2*a* shows the full bobbins 41, 43 located on the mounting spindles of two winding heads having push-out devices 42.

FIGS. 3*a* through 3*e* show a winding head 60 having one mounting spindle 19 on which two bobbins 41 are produced (note also FIGS. 2*a* to 2*d*). The yarns 61 and 62 pass through the thread guides 63 and 64 to the winding head. The yarns are deposited to and fro by traversing thread guides 66 and 67 and thereby each describe a so-called "traversing triangle" between the thread guides 63 and 64 and the respective bobbin. The traversing device and the drive roller 68 are positioned on a slide 65 which may be adjusted in elevation. Thereby, the drive roller may be selectively brought into circumferential contact with the bobbins and then raised from the surface of the bobbins. Winding heads of this type are described, for example, in German Offenlegungsschriften Nos. 2,040,479, 2,261,709 and 2,526,768. In the illustrated embodiment a plurality of winding heads are aligned along at least one side of the textile processing machine with the heads being positioned such that the spindles 19 project horizontally out from the front of the machine.

FIG. 3*d* shows that the winding head 60 contains devices for depositing the yarn on the empty bobbins. These devices are particuarly the thread depositing arm 69 with the thread catchers 70, 71 and the yarn reserve thread guides 72, 73. Attention is directed in this respect to German Offenlegungsshift No. 2,526,768, and U.S. Pat. No. 4,083,505.

Figure 4:
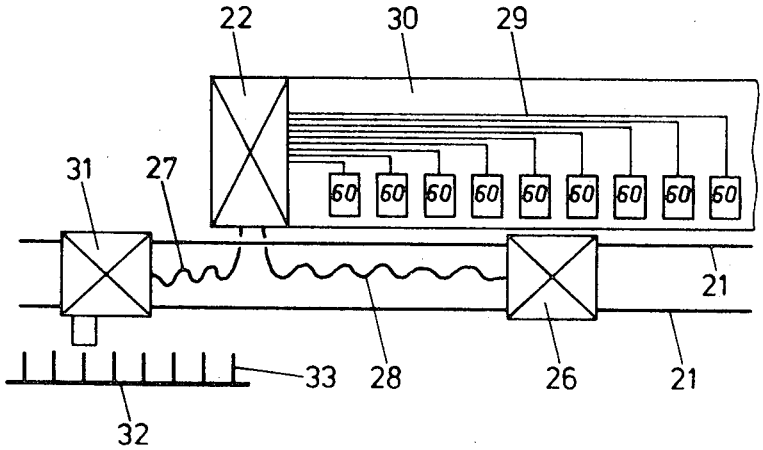
FIG. 4 is a schematic top plan view of a textile winding machine which includes a bobbin changing apparatus in accordance with the present invention.

FIG. 4 schematically shows the mutual cooperation between the individual winding heads 60 of a textile machine 30, such as a spinning frame, the microprocessor 22, the thread operating carriage 26, the doffing carriage 31 and the creel 32. It may be seen from this figure that the thread operating carriage 26 and the doffing carriage 31 may be operated independently of each other and are connected to the microprocessor 22 by flexible cables or tow lines 27 and 28. The microprocessor is connected on the other side to the individual winding heads 60 by lines 29 so that the microprocessor takes over the central control of the winding heads, the thread operating carriage, and the doffing carriage. The creel 32 may be positioned at any point along the rail path 21. As a result of dividing the thread operating functions and the doffing functions, the doffing carriage is thus free to transfer the bobbins from the individual winding heads onto the creel without thereby hindering the thread operating functions. As suggested in FIG. 4, it is possible and advantageous to position the creel 32 during the loading of the bobbins at a point in the area of the textile machine 30 and to make the doffing carriage 31 move to and fro between the creel and the individual winding stations. However, it is also possible to couple for a certain time the creel with the doffing carriage, so that the to-and-fro motion of the doffing carriage between the winding stations and the creel does not take place.

The course of the individual functions of the bobbin change will now be described. FIG. 3*a* shows that by a movement 101, the support arm 2 for the thread overrun guides 3, 4 and the support arm 5 with the thread deflection members 6, 7 are moved along a plane just below the thread guides 63, 64. The support arm 5 is now moved in the direction of the arrow 102. For this purpose, it has a yarn deflector 25 at its front (one deflector 25 being shown in FIG. 1, the other not being shown for clarity reasons), which deflectors insure that the thread deflection members 6, 7 do not come into contact with the yarns 61, 62. The traversing triangles which are defined between the fixed thread guides 63, 64 (forming the tips of the triangles) and the traversing thread guides 66,67 (forming the bases of the triangles) are therefore not disturbed by the movement 102 of the deflecting members 6, 7. Thereupon support arm 2 follows with movement 103 or, strictly speaking, movement 103*a*. Movement 103*a* is effected such that the front pair of thread overrun guides 3, 4 do not come into contact with the yarn 61. Thereby, the two pairs of thread overrun guides 3, 4 are moved to a position approximately vertically below respective thread guides 63, 64.

As may be seen in FIG. 3*b*, the support arm 5 with the deflection members 6, 7 is now returned in movement 104 to such an extent that the yarn is laterally deflected into a horizontally disposed U-shaped loop, and the yarn extending between the deflection members 6, 7 passes into a slit of the suction device 75 where the yarn is severed by a cutting device (step 105). The yarn advancing through thread guides 63, 64 and over the thread overrun guides 3 is now constantly removed by suction, while the other severed yarn end is wound onto the bobbins 41. The slide 65 is now moved upwards in movement 106 so that the drive roller 68 lifts from the bobbins 41. As may be seen in FIG. 2*a*, the receiving mandrel 40 of the doffing carriage was positioned in the meantime in alignment with the spindle 19. The U-shaped supporting bracket 39 is now pushed into the sliding block 44 until the mandrel 40 practically comes into contact with the end of the spindle 19 (movement 107). The push-out device 42 of the winding head 60 is then activated with movement 108, as may be seen from FIGS. 2*a* and 3*b*.

Figure 7:
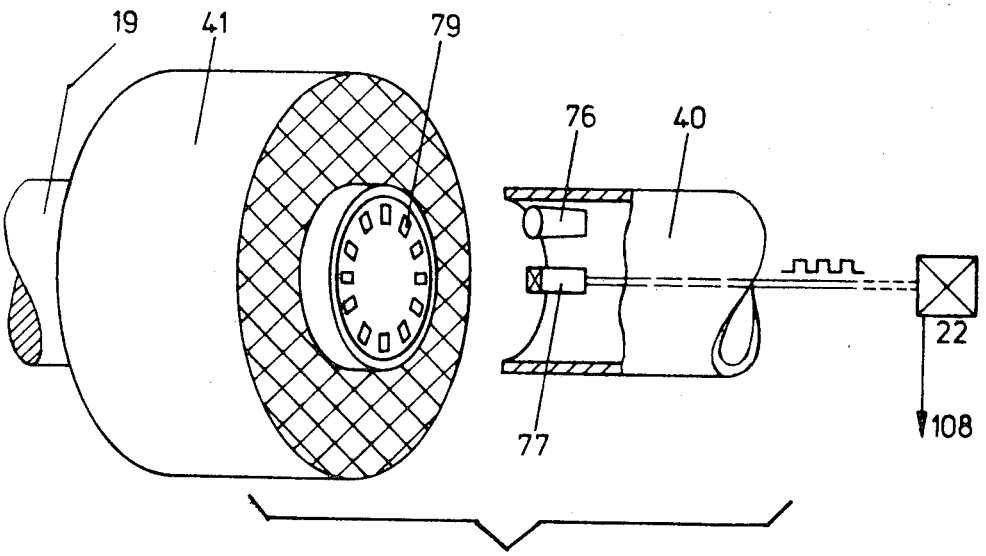
FIG. 7 is a schematic perspective view illustrating the sensor for monitoring the rotational movement of the mounting spindle of the winding station in accordance with the present invention.

For controlling operation of the push-out device, the mandrel 40 preferably is equipped at its front face with an illumination source 76 and a photocell 77, note FIG. 7. The illumination source 76 comprises a small bulb and lens for emitting a narrow beam of light. The spindle 19 has at the circumference of its front face a series of light reflecting foils 79 or plates, such as pasted aluminum foils. Hence, the rotation of the spindle 19, causes a series of impulses to be generated which are analyzed in the microprocessor 22 in such a way to enable the microprocessor to detect the nominal speed of the spindle, the deceleration period, the acceleration period, and the standstill of the spindle. The signal of the miroprocessor representing the cessation of rotation of the spindle 19, activates the push-out device. Since the push-out device catches behind the tubes of the full bobbin packages, both full bobbin packages are pushed onto the bobbin receiving mandrel 40 of the doffing carriage. The U-shaped supporting bracket 39 then returns into its starting position in movement 109 (FIG. 2*a*).

Figure 2B:
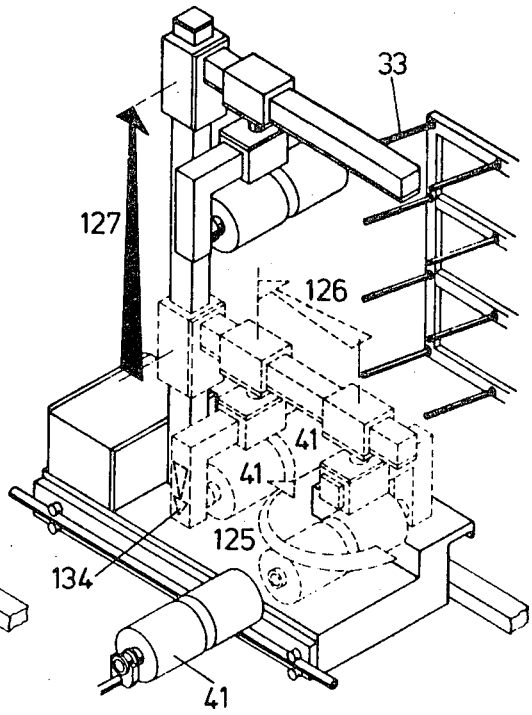
Figure 2C:
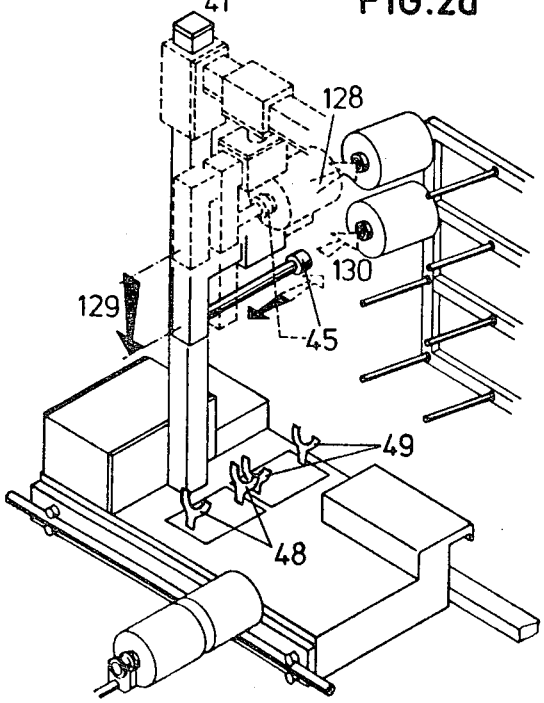
Figure 2D:
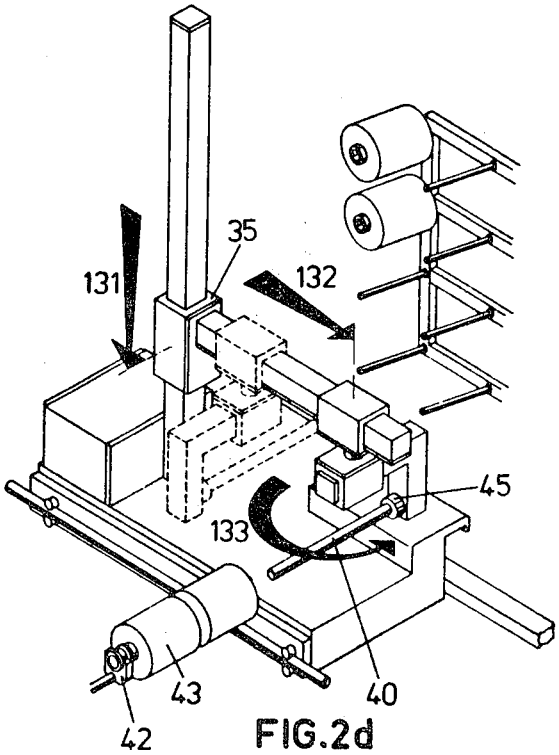

The further functions of the doffing carriage are now no longer related to the individual winding head, and these further functions are described below with reference to FIGS. 2*b*, 2*c* and 2*d*. The functional course of the thread operation will however first continue to be described.

As may be seen from FIG. 3*c*, when the full bobbins are doffed, the support arm 2 is returned into its starting position in movement 110 and thereby pivoted for a short time out of the yarn path. The housing 1 is then lowered on the column 8 in movement 113 to such an extent that the thread suction device 65 is now positioned below the horizontal plane of the spindle 19. The push-out device 15 (FIG. 1) is activated shortly before or simultaneously, whereby the tubes 13 are pushed out of the clamping device 12 of the thread operating carriage in movement 111 onto the spindle 19. A suitable construction of the spindle is described in German Pat. No. 2,106,493, which construction has the advantage that a clamping effect is only exerted when a torque is applied to the tubes. For this reason, the tubes may be moved axially without need for the spindle 19 to perform an additional operation. However, it is also possible to use a spindle in the form of a clamping chuck which is clamped or opened externally, e.g., pneumatically. A clamping chuck of this type is described for example in German Offenlegungsschrift Nos. 2,719,853 and 2,854,715. When using this type of clamping chuck, the clamping chuck is also simultaneously activated in a releasing sense with the drive 15 of the push-out device. This function may also be controlled by the microprocessor.

When the tubes 13 have been pushed onto the spindle 19, the slide 65 is lowered in movement 112 and the spindle is rotated with the tubes. The depositing arm 69 with the thread catchers 70, 71 is then pivoted forward (movement 114, FIG. 3*d*). The support arm 5 with the deflection members 6, 7 moves in front of the winding head and thereby performs the movements 115 or 116 respectively, and 117 in front of the respective thread catchers 70, 71. This results in the yarns being taken up by the thread catchers 70,71 and by the yarn reserve guides 72, 73. Details concerning this course of movement inevitably result from the respective construction of the thread catchers, which may be, for example, a thread guide with a lateral thread insertion slit. The support arm 2 is now returned again in movement 118 and the arm 69 is pivoted back in movement 119. Thereby, the yarn is caught at the tubes and is wound. The yarn reserve thread guides 72, 73 are simultaneously activated (movement 120), as a result of which the yarn reserve windings 74 are formed on the tube. The yarn then passes into the respective bobbin center and is there caught by the traversing thread guides 66, 67 and then deposited into a cylindrical bobbin.

The thread operating carriage may now move to another winding station. The command for this movement is received from the microprocessor, which obtains the impetus for this via a time control, or a diameter scanning or a thread break monitoring control.

In the meantime, the doffing carriage may perform other functions. By movement 125, the U-shaped supporting bracket 39 is pivoted by 180 degrees about the pivoting axle 38. The trolley 37 is then moved toward the support 34 by movement 126. The extension arm 36 is raised by movement 127 until the receiving mandrel 40 is aligned with a pin 33 of the creel.

When required, the U-shaped supporting bracket 39 may be moved in the sliding block in the direction of the pin 33. The push-out device 45 which is designed as an axially movable sleeve, is then activated in an axial direction and the first bobbin is thereby transferred onto the pin 33 in movement 128. The extension arm 36 and the slide 35 are then lowered in movement 129 to the height of the next pin and the second bobbin is transferred onto a separate pin of the creel by advancing the push-out device 45 in movement 130.

The slide 35 is then returned to the height of the winding heads in movement 131. The trolley 37 returns to a position in alignment with a winding head (movement 132), and the supporting bracket 39 is then pivoted about the pivoting axle 38 (movement 133). The course of movement may now restart according to FIG. 2*a* with the forward movement 107 of the supporting bracket 39.

Dividing the thread operational function and doffing function, and distributing these functions to two units which operate independently, provides the further advantage that additional functions may be transferred to one of these units without thereby delaying or hindering the functional course of the other unit.

By correspondingly programming the microprocessor and by the inventive division of the thread operation and doffing procedure, it is possible to deposit the bobbins onto the creel such that a clear allocation between the winding head on which the bobbin package has been produced and the depositing site (pin 33) is possible. This substantially facilitates the qualitative control.

Figure 5:
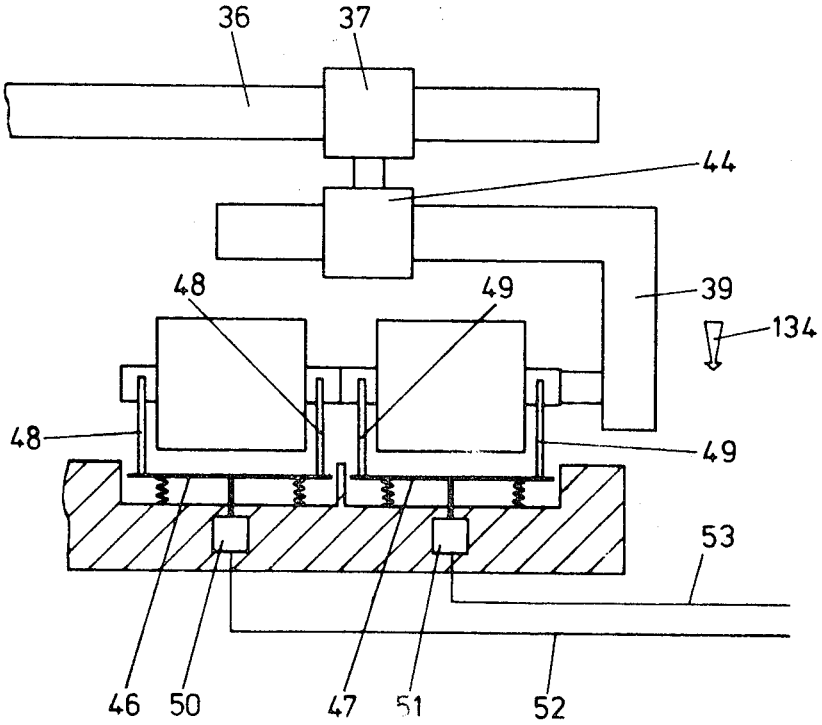
FIG. 5 is a fragmentary, partially schematic view of a doffing carriage with a weighing device in accordance with the present invention.

In order to ensure quality reliability, the doffing carriage is preferably provided with a base plate having spring-mounted weighing plates 46, 47 which are operatively connected to the sensing devices 50, 51 and via connection lines 52, 53 to the microprocessor, note FIG. 5. Aligned pairs of fork-like cradles 48 and 49 are located on the weighing plates 46 and 47 respectively, which pairs of cradles are spaced such that each pair supports the tube ends of one bobbin. By the lowering movement 134 of the receiving mandrel 40, the two full bobbin packages are mounted in the cradles 48, 49 and are individually weighed. The results of weighing proceed to the microprocessor. It is also possible to previously determine the tube weights and to establish the exact bobbin weight in the microprocessor. The weighing plates 46, 47 and cradles 48, 49 are preferably positioned such that the lowering movement 134 may take place subsequent to the pivoting movement 125. Weighing may easily be effected when the doffing carriage travels between the winding point and the creel, i.e., without a time loss.

Weighing allows an immediate determination of the winding results with respect to the bobbin weight, denier, evenness of the liquid preparation application, among other factors. It may particularly also be provided that each bobbin is immediately labeled with the labels being printed with the data produced by the microprocessor, by means of a printing device positioned on the doffing carriage. It is possible to stop the winding stations where the weighing result deviates from a pregiven set value or from an average value determined by the microprocessor, to avoid waste being produced when the quality tolerances are exceeded.

Figure 6:
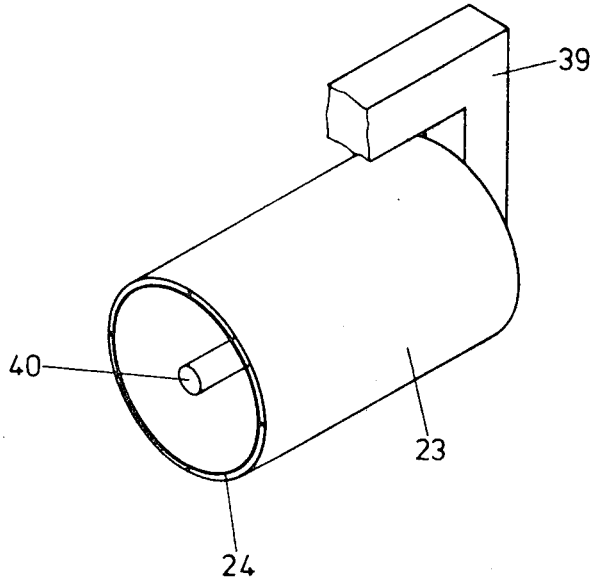
FIG. 6 is a fragmentary perspective view of a doffing carriage mandrel having a heating wire to sever yarn ends.

FIG. 6 shows a device for removing the yarn ends which hang down from the bobbin. Yarn ends of this type result in disturbances when they are inadvertently caught by moving machine parts or suction devices. The device comprises a cylinder 23 which concentrically surrounds the mandrel 40 on the doffing carriage, and has a diameter sufficient to receive a full bobbin. A heating wire 24 which is insulated with respect to the cylinder is positioned in the entry end of the cylinder on the interior circumference thereof. The wire 24 thus melts and severs the hanging yarn ends when the full bobbins are pushed onto the mandrel 40.

In the drawings and specification, there has been set forth a preferred embodiment of the invention, and although specific terms are empolyed, they are used in a generic and descriptive sense only and not for purposes of limitation.

That which is claimed is:

1. A bobbin changing apparatus adapted for use with a textile yarn processing machine having a plurality of yarn winding stations aligned along at least one side thereof and with the winding stations each having a bobbin mounting means, said apparatus comprising trackway means adapted to be disposed along at least said one side of said textile yarn processing machine, a thread operating carriage mounted for movement along said trackway means and to a position adjacent each winding station, and including means for severing and withdrawing the yarn being processed at an adjacent winding station, and for returning the yarn to its winding path when an empty bobbin has been positioned on the mounting means of such winding station, and a doffing carriage mounted for movement along said trackway means independently of said thread operating carriage and to a position adjacent each winding station, and including means for receiving a full bobbin from the mounting means of such adjacent winding station, and control means adapted for operatively interconnecting each winding station with each of said thread operating carriage and said doffing carriage, and for effecting movement of said thread operating carriage and doffing carriage to each winding station upon receipt of a signal, and for operatively actuating each of said thread operating carriage and doffing carriage upon being positioned adjacent such winding station.

2. The bobbin changing apparatus as defined in claim 1 wherein said thread operating carriage further comprises means for operatively positioning an empty bobbin on the winding means at the adjacent winding station.

3. The bobbin changing apparatus as defined in claim 2 wherein said means for operatively positioning an empty bobbin on the winding means includes storage means mounted on said thread operating carriage for storing a plurality of empty bobbins in an orderly arrangement, said storage means having a bobbin delivery outlet for permitting the empty bobbins to be sequentially withdrawn therefrom, and means for sequentially engaging a bobbin at said outlet and transferring the same onto the mounting spindle of the adjacent winding station.

4. The bobbin changing apparatus as defined in claim 3 wherein said means for engaging and transferring a bobbin includes a pivot arm having a bobbin engaging clamp mounted adjacent its free end, means mounting said pivot arm for pivotal movement about a horizontal axis to elevate the bobbin to a desired elevation, and means for then axially advancing the bobbin along a direction parallel to said pivotal axis to move the bobbin axially onto the mounting means.

5. The bobbin changing apparatus as defined in any one of claims 1–4 wherein said control means includes a data processing unit disposed separately from each of said thread operating carriage and doffing carriage, means for operatively interconnecting said data processing unit with each of said winding stations, and flexible cable means for operatively interconnecting said data processing unit with each of said thread operating carriage and said doffing carriage.

6. The bobbin changing apparatus as defined in any one of claims 1–4 wherein said apparatus further comprises a creel disposed adjacent said trackway means and including a plurality of rows of spaced projecting pins which are each adapted to receive and retain a full bobbin thereon, said bobbin receiving means of said doffing carriage includes a mandrel, means mounting said mandrel to permit the same to be selectively oriented and aligned with a selected pin on said creel, and means for axially ejecting a full bobbin from said mandrel and thus onto the selected pin, and wherein said control means includes means for moving said doffing carriage along said trackway means to a position adjacent said creel and then actuating said mounting and ejecting means of said doffing carriage to deposit each full bobbin onto a pin of said creel.

7. The bobbin changing apparatus as defined in claim 6 wherein said mandrel has an axial length equalling at least that of two bobbins, such that at least two bobbins may be coaxially mounted on said mandrel, and wherein said ejecting means is adapted to sequentially eject individual bobbins from said mandrel so as to permit each bobbin to be deposited on an individual pin of said creel.

8. The bobbin changing apparatus as defined in claim 6 wherein said means for mounting said mandrel includes a vertical support fixed on said doffing carriage, and means for interconnecting said mandrel to said vertical support so as to permit said mandrel to be selectively moved vertically, horizontally in each of two directions, and rotated about a vertical axis.

9. The bobbin changing apparatus as defined in claim 6 wherein said doffing carriage further comprises an annular heating wire mounted concentrically about said mandrel and having a diameter slightly greater than that of the full bobbin, and such that said heating wire is adapted to sever the yarn end of a full bobbin as it is received on said mandrel.

10. The bobbin changing apparatus as defined in claim 6 wherein said doffing carriage further comprises means for weighing the full bobbins carried thereby.

11. The bobbin changing apparatus as defined in claim 10 wherein said weighing means comprises a pair of fork-like cradles adapted to support a bobbin therebetween, and wherein said control means includes means for actuating said mandrel mounting means of said doffing apparatus so as to deposit the carried bobbin onto the fork-like cradles.

12. The bobbin changing apparatus as defined in any one of claims 1–4 wherein said thread operating carriage mounts a yarn waste container, and said means for severing and withdrawing the yarn comprises means for laterally deflecting the yarn into a horizontally disposed, U-shaped loop, means for severing the yarn at the base of such loop, and suction means for removing the severed end of the yarn to said waste container.

13. The bobbin changing apparatus as defined in claim 12 wherein said means for laterally deflecting the yarn comprises a first support arm having a pair of spaced apart thread guides mounted thereon, a second support arm having thread deflection means mounted adjacent the free end thereof, and means mounting said first and second arms for relative movement such that the thread deflection means of said second support arm moves transversely between said pair of thread guides of said first support arm so as to be adapted to engage a yarn passing therebetween, and such that the yarn is laterally deflected.

14. The bobbin changing apparatus as defined in claim 13 wherein said thread guides of said first support arm, and said thread deflection means of said second support arm, each comprise rollers.

15. The bobbin changing apparatus as defined in claim 14 wherein said laterally deflecting means further comprises pneumatic means for rotatably driving said rollers.

16. The bobbin changing apparatus as defined in any one of claims 1–4 wherein said bobbin receiving means of said doffing carriage comprises a mandrel, and means mounting said mandrel to permit the same to be oriented so that it may be selectively axially aligned with each of an adjacent mounting means and an adjacent pin of a creel or the like.

17. The bobbin changing apparatus as defined in claim 16 wherein said control means includes means operable upon the alignment of the mandrel with a mounting means for monitoring the rotational speed of such mounting means, and for generating a control signal upon the cessation of such rotation.

18. The bobbin changing apparatus as defined in claim 17 wherein said means for monitoring the rotational speed of the mounting means includes an illumination source and light responsive photocell means mounted at the free end of said mandrel, and a plurality of light reflecting members adapted to be mounted in a circular arrangement on the front end face of the mounting spindle.

* * * * *